United States Patent [19]

Kroell

[11] 4,239,119

[45] Dec. 16, 1980

[54] DISC SEPARATOR

[76] Inventor: Franz Kroell, 13405 NW. Greenwood Dr., Portland, Oreg. 97229

[21] Appl. No.: 32,274

[22] Filed: Apr. 23, 1979

[51] Int. Cl.[2] ..... B07C 9/00

[52] U.S. Cl. ..... 209/672; 209/361; 172/548; 210/488; 403/359

[58] Field of Search ..... 209/359-361, 209/233, 672, 271, 222; 403/359, 365; 210/488; 172/21, 120, 548

[56] References Cited

U.S. PATENT DOCUMENTS

| | | | |
|---|---|---|---|
| 622,035 | 3/1899 | Bray | 209/672 |
| 1,621,695 | 3/1927 | Tuite | 209/672 |
| 1,699,718 | 1/1929 | Robbins | 209/672 |
| 2,055,630 | 9/1936 | McLean | 209/672 X |
| 2,279,956 | 4/1942 | Sipe | 403/359 |
| 2,493,161 | 4/1948 | Du Bois | 403/359 X |
| 2,581,337 | 1/1952 | Lapik | 210/488 X |
| 3,173,493 | 3/1965 | Renault | 172/548 X |
| 3,306,441 | 2/1967 | Sanders | 209/672 |
| 3,865,499 | 2/1975 | Flichy | 403/359 |

FOREIGN PATENT DOCUMENTS

| | | | |
|---|---|---|---|
| 513934 | 6/1955 | Canada | 403/359 |
| 777333 | 6/1957 | United Kingdom | 403/359 |
| 1234207 | 6/1971 | United Kingdom | 403/359 |

*Primary Examiner*—Robert Halper

*Attorney, Agent, or Firm*—Klarquist, Sparkman, Campbell, Leigh, Hall & Whinston

[57] ABSTRACT

An improved disc separator in which discs are mounted on retainers to form multiple disc units and the units are mounted end-to-end on a shaft and are clamped in place thereon. The discs have internal splines that project through and beyond splining slots in segments of the retainer, one spline only on each disc being wider than the others and adapted to fit closely in any of the slots in the retainer. The splines project slightly beyond the inner surface of the retainer and are swaged to hold the retainer segments rigidly in fully expanded positions.

7 Claims, 4 Drawing Figures

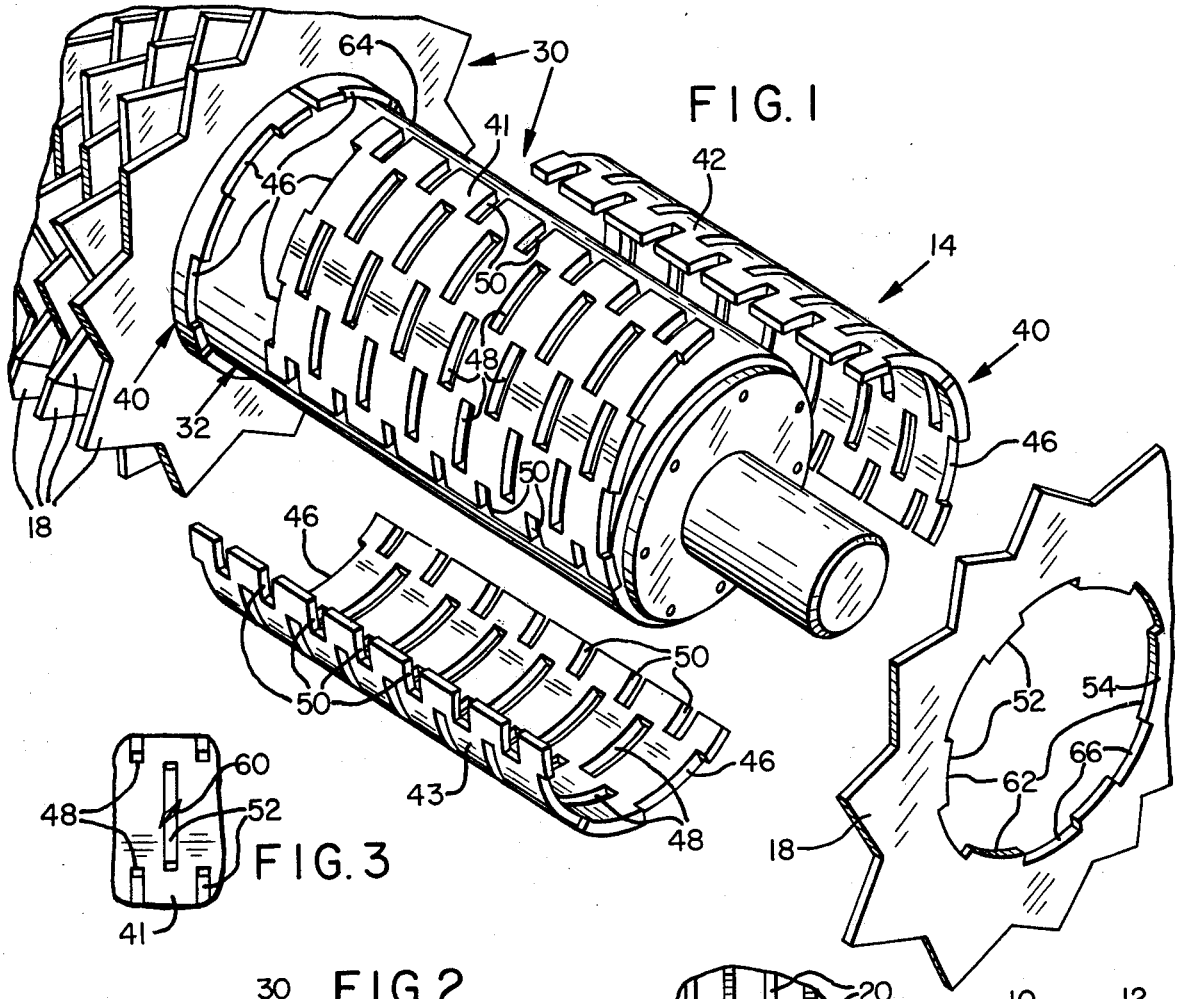
FIG. 1
FIG. 3
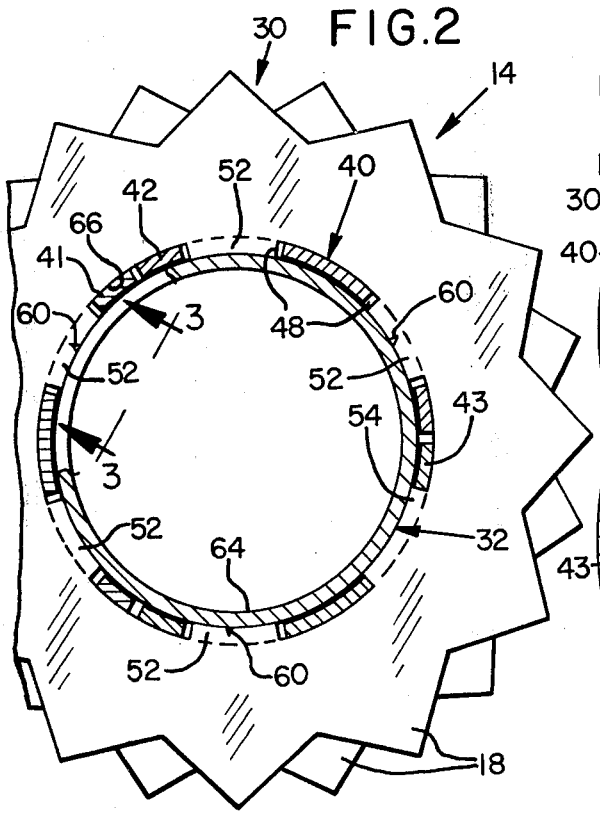
FIG. 2
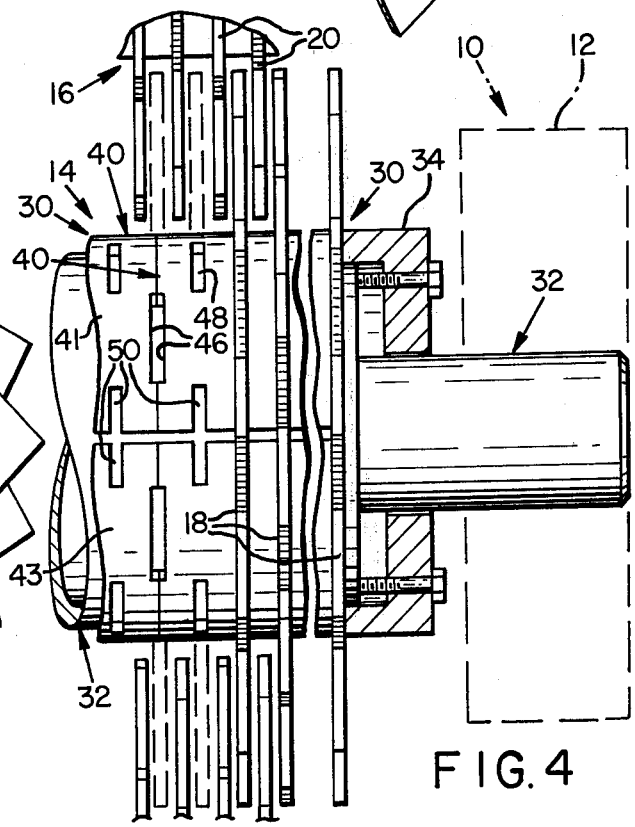
FIG. 4

DISC SEPARATOR

DESCRIPTION

This invention relates to an improved disc separator, and has for an object thereof the provision of a new and improved disc separator.

Another object of the invention is to provide a disc separator in which discs are mounted on retainers to form multiple disc units which are mounted end-to-end on shafts.

A further object of the invention is to provide a multiple disc unit in which longitudinal retainer segments have slots receiving internal teeth of annular discs to hold the discs in parallel, axially aligned positions.

Another object of the invention is to provide a multiple disc separator unit in which internal splines of annular discs project through slots in three or more arcuate retainer segments and are held by the retainers.

In the drawings:

FIG. 1 is a fragmentary, exploded view of an improved disc separator forming one embodiment of the invention;

FIG. 2 is an enlarged, vertical, sectional view of the separator of FIG. 1;

FIG. 3 is a fragmentary, enlarged view taken along line 3—3 of FIG. 2; and, FIG. 4 is an enlarged, fragmentary top plan view of the separator of FIG. 1.

Referring now in detail to the drawings, an improved disc separator shown therein and forming a specific embodiment of the invention includes a frame 10 having sides 12 and a plurality of rotatable disc assemblies 14 and 16 mounted rotatably on the frame in parallel positions. The disc assemblies have interleaving separator discs 18 and 20 and are identical except for the staggered positions of the discs, and, hence, only the assembly 14 will be described in detail.

The disc assembly 14 comprises multiple disc units 30 mounted end-to-end on a shaft assembly 32 and clamped between abutments 34 on the ends of the shaft to lock the units on the shaft against longitudinal movement relative to the shaft and to key the units to the shaft. Each unit 30 includes a retainer 40 including three arcuate retainer segments 41, 42 and 43 having notch-like, half width end slots 46, inner slots 48 and side edge slots 50. The discs are annular and have equiangularly spaced inner teeth or splines 52 and 54, the splines 54 being somewhat arcuately longer than the splines 52. The arcuate length of each spline 54 is equal to the arcuate length of each inner slot 48 and those of the end slots 46 aligned longitudinally with the inner slots so that the splines 54 which are positioned in the inner slots 48 and those of the end slots aligned with the slots 48, key the discs to the retainer segment through which the splines 54 extend. This precisely locates the discs circumferentially relative to the retainer. The splines 52 are somewhat less wide (less in arcuate length) than the slots 48 to provide clearance for assembling the retainer segments in the discs.

The length or radial height of the splines 52 and 54 of each disc 18 is somewhat greater than the thickness of the retainer segments 41, 42 and 43, and the segments are held in positions fully expanded radially by swaged portions 60 of at least one of the splines 52 and 54 projecting through each segment. The splines have inner arcuate edges 62 lying in a cylinder and fitting closely on a cylindrical tube 64 of the shaft assembly 32. The splines 52 and 54 of each disc 18 are separated by arcuate lands 66 lying in a cylinder and the retainer segments are pressed against the lands 66 by the swaged portion 60.

The splines 52 and 54 all have the same thickness, which is just slightly less than the width of each of the slots 48 and 50. The width of each end slot 46 is no greater than one-half the thickness of the splines so that the splines of the end discs are firmly held between the two adjacent retainers. The retainer 40 is cylindrical, and each of the segments 41, 42 and 43 subtends an angle of slightly less than 120° so that the segments can be radially expanded easily onto the splines during the assembly of the unit. Thus, edge slots 50 are not quite half as long as the inner slots 48. The slots for each disc are staggered relative to the slots for the discs immediately adjacent to that disc.

In a preferred embodiment of the invention, the diameter of the tube 64 is six and one-half inches, the thickness of the retainer segments 41, 42 and 43 is three-sixteenth of an inch and the height of the splines is one-quarter of an inch. The retainer segments may be of steel and may be formed by punching the slots through a flat sheet of steel with a numerically controlled punching machine, cutting the segments and forming the segments to their arcuate shape. The tolerances of the width of the slots is thus held to plus or minus one thousandth of an inch, non-accumulative. The discs 18 and 20 may be punched from stainless steel sheet material.

In operation, the disc assemblies 14 and 16 are connected to a suitable drive mechanism (not shown) so that each is driven in the same direction. Material to be separated or graded is then fed on to the top of the table of discs at the feed end. The motion of the discs will cause the material supported on the discs to be propelled toward the opposite end of the table. Material having a dimension less than the spacing between the interleaved discs will fall through between the discs, the larger material being carried on the top eventually to be discharged off the end opposite the feed end. Many types of materials can be processed. For example, pulp chips can be separated from knots, wood chunks, frozen lumps or the like. Disintegrated materials, such as, ground up domestic waste can be screened to separate the finer particles for combustion processes from the larger particles for other types of processing.

While the retainer 40 is shown as made up of three segments 41, 42 and 43, for larger diameter shafts, it may be desirable to use more than three segments, each such segment being less than 120°, of course.

What is claimed is:

1. In a disc separator having at least one cylindrical shaft and a plurality of annular separator discs received on said shaft, retainer means for retaining said discs, said retainer means comprising an annular sleeve member mounted exteriorly on said shaft, said annular sleeve member comprising a plurality of arcuate segments, said arcuate segments having spaced rings of arcuate circumferentially-extending slots extending therethrough, said discs having internal splines extending into the slots.

2. The separator of claim 1 wherein the segments include aligned pairs of circumferentially-extending half slots along the abutting side edges thereof to receive said splines.

3. The separator of claim 1 wherein the segments are mounted end-to-end on said shaft and include circumferentially-extending half width slots in the ends thereof to receive said splines.

4. The separator of claim 1 wherein each of said splines has a predetermined radial height, the thickness of said segments being less than said predetermined radial height whereby a portion of each of said splines extends inwardly of said segments toward said shaft.

5. The separator of claim 4 in which said portions of at least some of said splines extending inwardly of said arcuate segments are swaged to hold said segments in radially expanded positions.

6. The separator of claim 4 further comprising means to hold said arcuate segments in radially expanded positions.

7. The separator of claim 1 wherein one spline only on each disc is arcuately circumferentially larger than the other splines thereon, said one spline being adapted to fit closely within said slots precisely to locate said discs circumferentially relative to said segments.

* * * * *